United States Patent [19]

Grusin

[11] Patent Number: 4,700,842

[45] Date of Patent: Oct. 20, 1987

[54] STACKABLE STORAGE CONTAINER

[75] Inventor: Gerald M. Grusin, Chicago, Ill.

[73] Assignee: Dart Industries, Inc., Northbrook, Ill.

[21] Appl. No.: 520,828

[22] Filed: Aug. 5, 1983

Related U.S. Application Data

[63] Continuation of Ser. No. 299,297, Sep. 3, 1981, abandoned.

[51] Int. Cl.[4] ..... B65D 21/02

[52] U.S. Cl. ..... 206/508; 206/509

[58] Field of Search ..... 206/508, 509

[56] References Cited

U.S. PATENT DOCUMENTS 3,338,468 8/1967 Wilson ..... 206/508

3,412,888 11/1968 Andrews ..... 206/508

3,701,455 10/1972 Warnecke ..... 206/509

FOREIGN PATENT DOCUMENTS 2428576 2/1980 France ..... 206/509

2035277 6/1980 United Kingdom ..... 206/508

*Primary Examiner*—George E. Lowrance

*Attorney, Agent, or Firm*—Jones, Askew & Lunsford

[57] ABSTRACT

Stackable storage containers especially useful for storing foodstuffs and the like. The underside of each container has one or more end panels each presenting a beveled surface relative to the container bottom. The closure for the container includes a like number of angled ramp surfaces facing upwardly from the closure, to receive the beveled end surfaces on the underside of a like container stacked on the closure.

9 Claims, 7 Drawing Figures

STACKABLE STORAGE CONTAINER

This application is a continuation, division, of application Ser. No. 299,297, filed Sept. 3, 1981 abandoned.

FIELD OF THE INVENTION

This invention relates in general to storage containers, and relates in particular to containers for storing foodstuffs or the like.

BACKGROUND OF THE INVENTION

Containers for storing small quantities of food and the like are well known and are widely used in households and elsewhere. These containers may be made of deformable plastic material such as polyethylene or the like, and typically come with an easily-detachable lid or closure to provide a seal with the container. Such foodstuff containers are available in a variety of shapes and sizes, and frequently are stored on refrigerator shelves or the like by stacking the containers one atop the other.

Food storage containers of the prior art generally have bottom surfaces and closures which are flat, or which at least have substantial flat portions. Although these flat tops and bottoms permit the containers to be stacked, a stack of two or more such prior art containers as a practical matter may be awkward or difficult to unstack. Containers of the same general size and configuration frequently have a surface-contacting base which can fit on top of the lid or closure for the container, due to the overall shape of the container. The closure typically has a raised peripheral rim surrounding the surface on which the base of a superadjacent container rests, and this rim can interfere with attempts to remove a selected container from a stack of such containers. This limitation on sideways displacement easily leads to tipping or knocking over a stack of containers, especially where several containers are stacked in an array from which one attempts to withdraw an intermediate container.

Attempting to improve unstackability of stacked containers simply by doing away with the rim surrounding the closure of the same size would be less than satisfactory. The close bottom-to-top conforming fit of such stacked containers provides a desired stability of stached containers. Moreover, the peripheral rim of the conventional closure provides the sealing engagement with the container, and thus is considered an important feature of the closure.

SUMMARY OF THE INVENTION

The foregoing and other problems associated with foodstuff containers of the prior art have been overcome or substantially alleviated by the stackable covered storage container of the present invention. Stated in general terms, the present container includes a bottom wall having a central portion which may be substantially flat, and having at least one end portion sloping or beveled upwardly from the central portion. The container includes a removable closure having a central portion configured to receive the bottom wall central portion of a like container stacked on the closure. The closure also may include at least one upwardly sloping portion to receive the sloping or beveled bottom portion in complementary fit, so that the sloped bottom wall of the container engages the sloped portion on the closure of a like container stacked therebelow.

Stated somewhat more specifically, the container closure may include a pair of ramp surfaces flanking a central panel on the closure. The container bottom wall has beveled surfaces at opposite ends of a central region, and a central portion which can rest on the central panel of the closure. Each beveled surface of the bottom is aligned to fit onto a corresponsing ramp surface of the closure on which the container is stacked. the ramp surfaces of the container closure are preferably spaced inwardly from the periphery of the closure, and thereby elevate part of the stacked container upwardly a short distance from the closure immediately below. This slight elevation between stacked containers, as well as the beveled surfaces at the ends of the container, promotes easy removal of a container from a stack of such containers.

Accordingly, it is an object of the present invention to provide an improved storage container for foodstuffs or the like.

It is another object of the present invention to provide an improved food storage container which is easily unstackable from a stack of containers.

It is yet another object of the present invention to provide a storage container having relatively good stability when stacked on like containers, yet which is easily removed from a stack of containers.

The foregoing and other objects and advantages of the present invention will become more readily apparent from the following description of a disclosed embodiment, including the drawings.

DESCRIPTION OF PREFERRED EMBODIMENT

Figure 1:
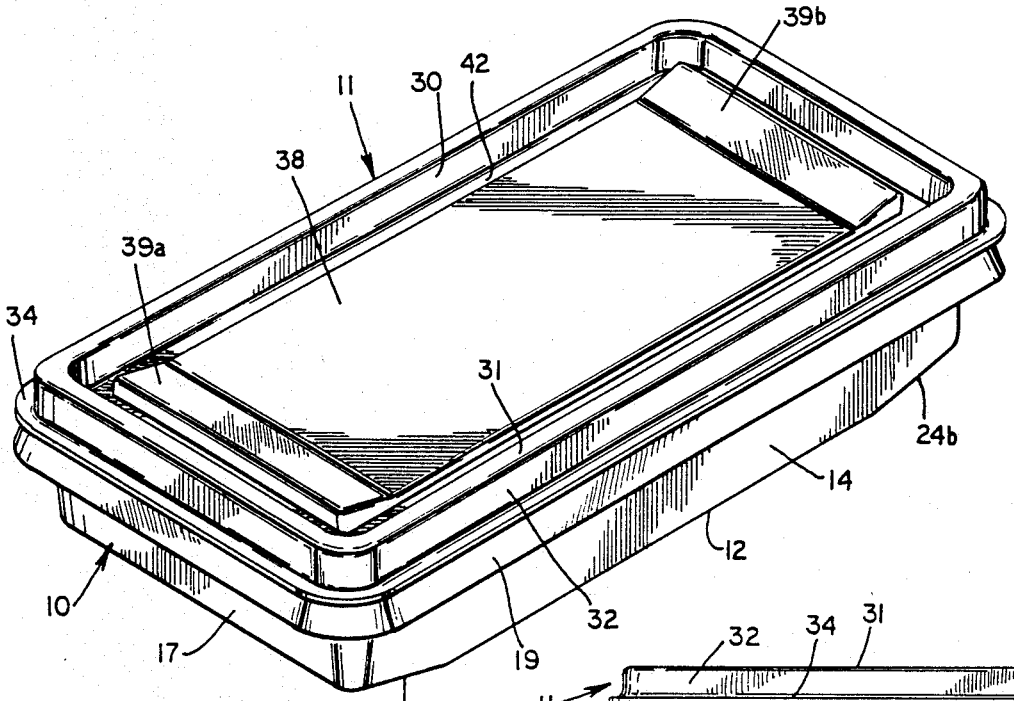
FIG. 1 is a pictorial view showing a covered stackable storage container according to a preferred embodiment of the present invention.

Turning to the Figures, there is shown generally at 10 a container according to the disclosed embodiment, fitted with a closure shown generally at 11. Both the container and closure preferably are made of a suitable molded plastic material such as polyethylene or the like. The container 10 and its closure are generally rectangular in overall configuration, although it should be understood that other shapes may be utilized in the practice of the present invention.

The container has a bottom wall 12 and unitary side walls 13 and 14 extending upwardly from the bottom wall to terminate at an upper edge 15 which defines the open mouth 16 of the container. The container 10 further includes a pair of end walls 17 and 18 unitary with the bottom wall 12, and extending upwardly from the bottom wall to terminate at the upper edge 15. A skirt 19 having a downwardly-facing open channel surrounds the container 10 a short distance below the open mouth 16, and it will be appreciated that the skirt preferably is molded as a unitary part of the container.

Figure 3:
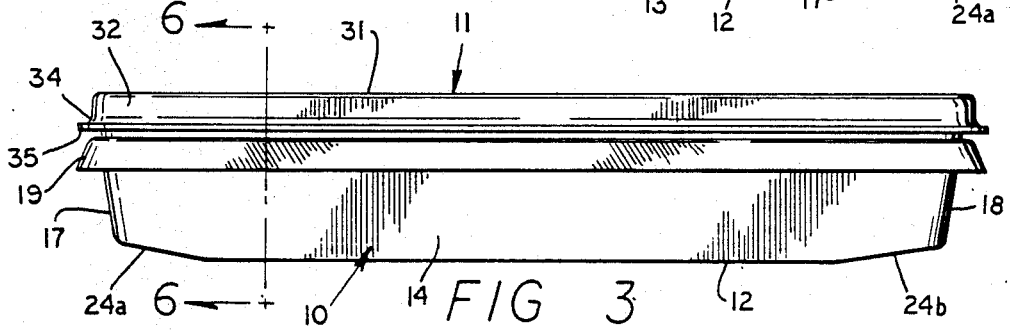
FIG. 3 is a side elevation view of the closed container show in FIG. 1.
Figure 4:
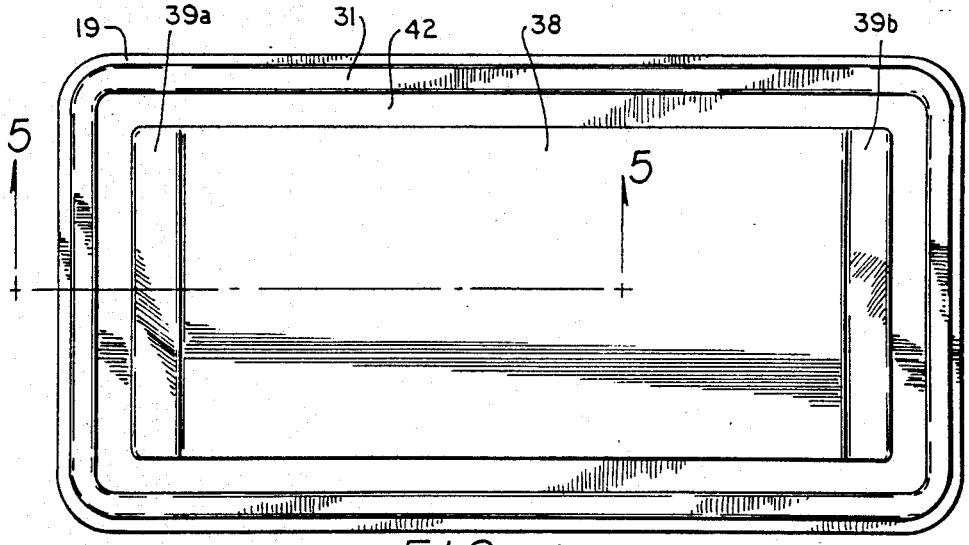
FIG. 4 is a top plan view of the closed container shown in FIG. 1.
Figure 5:
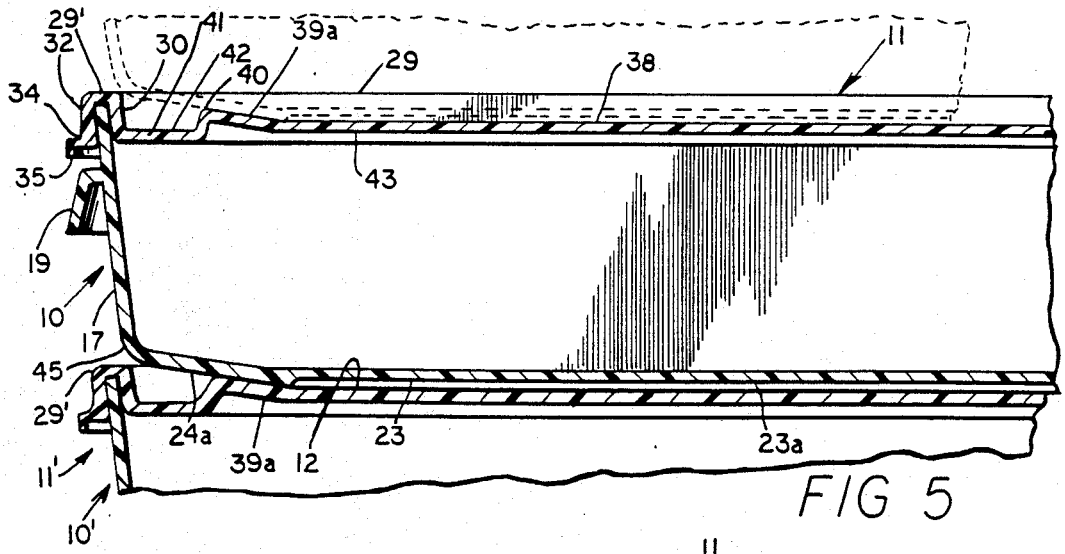
FIG. 5 is a section view taken along line 5—5 of FIG. 4, with a fragmentary lower container and a phantom upper container added to illustrate a stack of containers.

As best seen in FIGS. 3 and 5, the bottom wall 12 includes a substantially flat central panel 23 flanked by a pair of end panels 24*a* and 24*b* which are formed to be beveled upwardly at an acute angle to join the respective end walls 17 and 18. The beveled end panels 24*a* and 24*b*, as best seen in FIG. 3, occupy but a relatively small proportion of the overall length of the bottom wall 12, so that the flat central panel 23 making up the greater portion of the bottom wall provides a flat, relatively stable support for the closure 10 on a flat supporting surface such as a countertop or the like.

Figure 2:
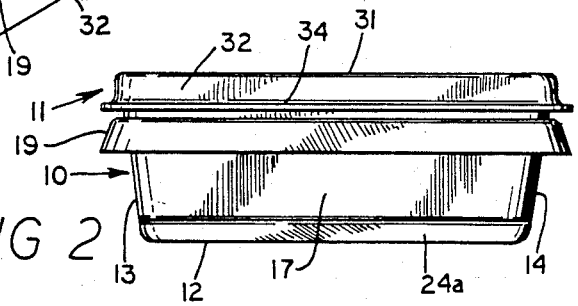
FIG. 2 is an end elevation view of the closed container shown in FIG. 1.
Figure 6:
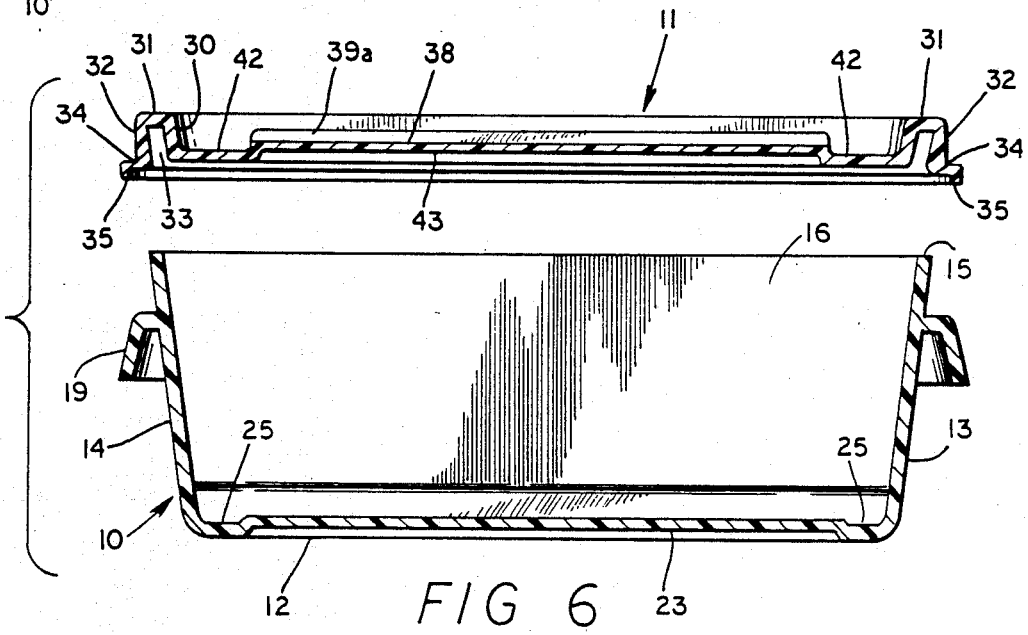
FIG. 6 is a section view taken along line 6—6 of FIG. 3, with the closure shown removed and elevated above the container for illustrative purposes.

It is also seen from FIGS. 3 and 5 that the end walls 17 and 18 are tilted outwardly a slight extent relative to vertical; the same nonperpendicular attitude exists with the side walls 13 and 14, as seen in FIGS. 2 and 6. This nonperpendicularity of the side walls and end walls is not essential to the present invention, although present in the disclosed embodiment.

The downwardly-facing exterior surface 23a of the bottom wall central panel 23 may be recessed slightly above the nominal surface of the container bottom wall 12, as best seen in FIGS. 5 and 6. This recessed feature of the bottom wall 12 produces the slight longitudinally-extending channels 25, FIG. 6, flanking the interior surface of the central panel 23 within the container 10.

The closure 11 has a peripheral upstanding rim 29 provided by an interior wall 30, an end wall 31, and an exterior wall 32 combined to form an annular downwardly-facing channel 33 configured to removably fit onto the upper edge 15 of the container 10. A skirt 34 surrounds the periphery of the outer wall 32, and the skirt includes a down-turned flange 35 positioned to extend outwardly a short distance from the side walls and end walls of the closed container 10, as best illustrated in FIG. 5. The flange 35 of the closure is located a short distance above the top of the skirt 19 on the container, when the closure is in place.

The closure 11 includes a central panel 38 flanked by a pair of ramp-defining surfaces 39*a* and 39*b* near the respective longitudinal ends of the central panel. The upper edges 40 of the ramp surfaces 39*a* and 39*b* are spaced inwardly a short distance from the confronting portion 29′ of the rim 29 surrounding the closure, as most clearly shown in FIG. 5, so that a panel end portion 41 is present between the rim portion 29′ and the upper edge 40 of each shoulder. Each ramp surface 39*a* and 39*b* thus is separate from the rim 29, which can function in the conventional manner to secure the closure 11 to the container 10 without interference from the structure making up the ramp surface. The central panel 38, as best seen in FIGS. 1 and 6, is elevated slightly above the surrounding longitudinal side portions 42 and end portions 41 of the closure, defining a slight depression 43 in the underside of the closure. The upper edge 40 of each ramp preferably is slightly lower in elevation than the rim 29 of the closure.

It should now be apparent that the ramp surfaces 39*a* and 39*b* on the closure 11 are complementary to the beveled surfaces of the end panels 24*a* and 24*b* on the bottom of the container 10. As a container 10 is stacked on the closure 11′ of a like container 10′, FIG. 5, the beveled end panels 24*a* and 24*b* of the upper container rest on the respective ramp surfaces 39*a* and 39*b* (not shown in FIG. 5) of the supporting closure. The angles of the end panels 24*a*, 24*b* preferably are the same as the angles of the ramp surfaces 39*a*, 39*b*, so that the complementary engaging end panels and ramp surfaces provide a relatively stable stacking of two or more containers so equipped. Because the ramps 39*a*, 39*b* are shorter than the end panels 24*a*, 24*b* as best seen in FIG. 5, the outermost extent 45 of each end panel (joining the respective end wall 17 or 18 of the container) extends outwardly beyond the upper edge 40 of the corresponding ramp surface and is substantially aligned with the confronting portion 29′ of the closure rim. This aligned relation of each stacked container, relative to the peripheral rim on the closure of the subjacent supporting container, facilitates removing one such container from its position in a vertical stack of like containers, inasmuch as a person can easily grasp the selected container at the open spaces provided between the ends of that container and the rim of the closure on the lower supporting container. Moreover, the beveled ends of the container 10 enhance unstackability even when the container rests on a flat closure lacking ramp surfaces or the like, inasmuch as the outermost extent of each beveled end is aligned with the closure rim and guides the container over the peripheral rim of the closure.

Figure 7:
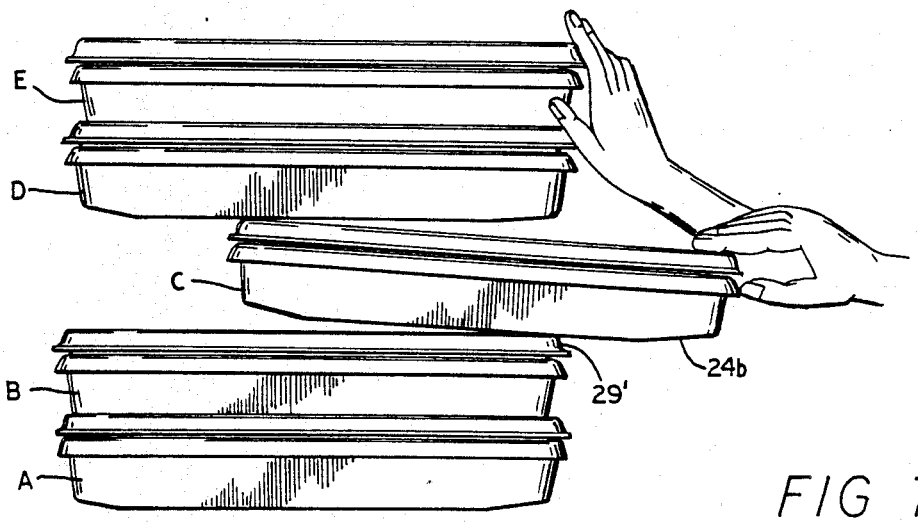
FIG. 7 is a side elevation view showing one of the disclosed containers being withdrawn from a stack of such containers.

The enhanced unstackability of the present container is illustrated in FIG. 7, where several stacked containers A, B, C, D, and E are shown as they might be placed on a shelf. The middle container C, for example, is withdrawn from the stack simply by grasping the container end and pulling away from the stack, while simultaneously placing a hand against the upper containers D and E to hold the upper containers in place in the stack. The beveled end surface 24*b* of container C rides up and over the confronting rim 29′ of the lower container B, enabling the container C to be removed from the stack without interference from the rim of the lower container.

It should now be evident that the present storage container offers enhanced unstackability over previous such containers, without sacrificing the desirable feature normally associated with such containers. The ramp surfaces formed on the closure of the present container engage the beveled end panels of a like container to support that container with enhanced stability, tending to prevent the supported container from sliding or other unwanted movement in stacked relation. At the same time, the central panel 38 between the ramp surfaces on the closure receives the central panel 23 on the bottom of the container, thereby providing a relatively broad supporting surface to receive the weight of the above container. As a result, containers according to the present invention tend to remain nested or stacked together notwithstanding some degree of jostling or movement, until it is desired to separate the containers by lifting one off another.

It should also be apparent that the foregoing relates to but a disclosed embodiment of the present invention, and that numerous modifications and changes may be made therein without departing from the spirit and scope of the invention as defined in the following claims.

I claim

1. A stackable covered storage container, comprising:

a container comprising a bottom wall having sides and ends, and further comprising side walls and end walls extending upwardly from the sides and ends of said bottom wall to form an open mouth of the container;

said bottom wall having a substantially flat central portion, and having at least one end panel sloping upwardly from an end of said central portion to form a beveled surface joining said end of the central portion to the adjacent end wall;

a closure configured to fit on said open mouth of said container;

said closure including a central panel having sides and ends, and configured to receive the bottom wall central portion of a like container stacked on the closure; said closure having a peripheral rim flanking said sides of said central panel to extend above a portion of the side walls of the like container stacked on the closure, said peripheral rim thereby obstructing sideways sliding movement of the stacked like container; and a ramp portion sloping upwardly from said closure central panel adjacent one end of said central panel to receive said bottom wall beveled surface of a stacked like container in complementary fit, so that the complementary ramp portion and beveled surface permit sliding relative movement of a stacked container along siad one ends to remove a container from the stack, and said peripheral rim obstructs such movement along said sides.

2. A storage container as in claim 1, wherein:

said beveled surfaces of said bottom wall extend beyond said ramp portions of the closure on which the container is stacked, so that said end walls of the stacked container are approximately aligned with said peripheral rim of the closure.

3. A storage container as in claim 1, wherein:

said end panel of the container bottom wall comprises one of a pair of mutually spaced apart end panels at the ends of the bottom wall, said pair of end panels forming a pair of beveled surfaces separated by said substantially flat central portion so that each beveled surface is disposed between the bottom central portion and a contiguous end wall of said container; and said ramp portion of the closure central panel comprises one of a pair of mutually spaced apart ramp portions sloping upwardly from the central panel at opposite ends of said central panel to provide a complementary fit to said beveled surfaces on the bottom wall of a like container stacked therein, so that said beveled surfaces and said ramp portions permit relative sliding movement of stacked containers along either end of the closure and said peripheral rim obstructs sideways sliding movement of the stacked containers.

4. A storage container as in claim 1, wherein:

said peripheral rim extends around the exterior of said closure; and further comprising a pair of said ramp portions disposed on said exterior in mutually spaced apart relation at opposite ends of said central panel so that said central panel is between said ramp portions;

said ramp portions being spaced inwardly from said peripheral rim; and said bottom wall having a pair of said beveled surfaces in spaced apart relation to said bottom wall central portion and complementary to said ramp portions of said closure, so that said beveled surfaces and said ramp portions permit relative sliding movement of stacked containers along either end of the closure, and the beveled surfaces promoting sliding movement of the container over the peripheral rim of the subjacent closure.

5. A stackable covered storage container, comprising:

a rectangular container having a bottom wall defining sides and ends, and having side walls and end walls extending upwardly from said bottom wall to terminate at upper edges forming an open mouth of the container;

a closure of rectangular shape configured to fit on the open mouth of said container;

said closure having an outer surface including a central panel flanked by a pair of ramp surfaces in mutually spaced apart relation along a first rectangular axis and each diverging from said central panel;

said ramp surfaces being located inwardly in spaced relation from respective edges of said rectangular cover;

said closure having a peripheral rim extending upwardly on said outer surface and flanking said central panel;

said bottom wall of said container having a substantially flat central region configured to fit in alignment over the central panel of a like closure on which said container is stacked;

said bottom wall having a beveled surface at opposite ends of said central region, each beveled surface resting on a respective ramp surface of the like closure as the bottom wall is aligned above the central panel of the like closure on which the container is stacked, so as to centrally position a stacked plurality of said containers; and said peripheral rim on the closure extending above the sides of said bottom wall of the stcked container to abut a portion of said side walls, thereby obstructing sideways movement of the like container stacked on the closure;

whereby one or more containers can be withdrawn from the stack by sliding movement along said ends to move said beveled surfaces along confronting ramp surfaces, but said peripheral rim engages the side walls of adjacent stacked containers to prevent sideways sliding movement.

6. A stackable container as in claim 5, wherein:

each beveled surface joins opposite ends of said bottom wall to the contiguous end walls of said container; and said beveled surfaces extend outwardly beyond the corresponding inwardly located ramp surfaces of the like closure when the container is stacked, allowing the outer end of each beveled surface to be spaced vertically apart from said outer surface of the central panel on the closure of an underlying stacked container, so that the stacked containers may be separated by grasping the vertically spaced apart outer ends.

7. A stackable coverable storage container, comprising:

a container comprising a bottom wall having sides and ends, and further comprising side walls and end walls upwardly from the bottom wall to form an open mouth to receive a closure fitting onto said open mouth;

said bottom wall having a substantially flat central portion, and having at the ends a pair of mutually spaced apart sloping end panels separated by said central portion, each sloping portion forming a beveled surface joining the bottom central portion to an adjacent end wall of said container; and said side walls extending substantially upwardly from the sides of said bottom wall without joining beveled surfaces.

8. A container as in claim 7, wherein each said beveled end surface extends upwardly from said substantially flat central portion and joins the contiguous end wall in elevated relation to said central portion.

9. A closure for removable attachment to the open mouth of a storage container having a bottom wall, side walls, and end walls extending upwardly from the sides and ends of the bottom wall to form said open mouth, said closure comprising:

a closure member having a peripheral rim configured to fit on the open mouth of said storage container;

said closure member having an outer surface and said peripheral rim protruding outwardly therefrom, and having a panel within said peripheral rim;

a pair of ramp surfaces mutually spaced apart at opposite ends of said closure member and flanking a central portion of said panel;

said ramp surfaces being spaced inwardly and downwardly from the peripheral rim, and being raised above the panel to receive and support the bottom wall of a like container stacked on said closure, so that at least a portion of the bottom wall of the stacked container is supported above the pael of said closure to facilitate removing the stacked container from the supporting closure;

said ramp surfaces being located within said rim of the closure;

said ramp surfaces having slopes confronting each other in spaced apart relation on opposite ends of said central portion of the panel; and said peripheral rim extends upwardly from each side of said closure member and flanks said central portion, so that the ramp surfaces engage and support a complementary bottom portion of a container stacked on said closure while permitting relative sliding movement along said ramp surfaces to clear said peripheral rim, and said peripheral rim blocks relative sideways sliding movement of said stacked containers.

* * * * *